US006371830B1

(12) United States Patent
Wu et al.

(10) Patent No.: US 6,371,830 B1
(45) **Date of Patent: *Apr. 16, 2002**

(54) TOY VEHICLE WITH VARIABLE DRIVE AND VARIABLE SPEED

(75) Inventors: Wai Kwok Wu, Fanling; Yiu Kuen Kwan, Tai Po, both of (HK)

(73) Assignee: Acekey Limited, Shatin New Territories (HK)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/219,592

(22) Filed: Dec. 23, 1998

(51) Int. Cl.[7] ..... A63H 29/00
(52) U.S. Cl. ..... 446/457; 446/465
(58) Field of Search ..... 446/436, 457, 446/460, 438, 465; 180/247, 65.1

(56) References Cited

U.S. PATENT DOCUMENTS

| | | | | | |
|---|---|---|---|---|---|
| 14,039 | A | | 1/1856 | Williamson | 417/103 |
| 401,228 | A | | 4/1889 | Tiemann | 68/144 |
| 465,592 | A | | 12/1891 | Evans | 105/119 |
| 1,084,084 | A | | 1/1914 | Guerra | 74/425.5 |
| 2,883,796 | A | * | 4/1959 | Reveka | 446/219 |
| 3,080,827 | A | | 3/1963 | Zion | 105/101 |
| 3,628,284 | A | * | 12/1971 | Soulakis | |
| 3,712,359 | A | | 1/1973 | Williams | 152/158 |
| 3,810,515 | A | | 5/1974 | Ingro | 180/54.2 |
| 3,835,583 | A | | 9/1974 | Manning | 446/465 |
| 3,849,931 | A | | 11/1974 | Gulley | 446/175 |
| 4,113,255 | A | | 9/1978 | Goldfarb et al. | 273/108 |
| 4,276,717 | A | * | 7/1981 | Zbriger | |
| 4,306,375 | A | | 12/1981 | Goldfarb et al. | 446/219 |
| 4,443,968 | A | | 4/1984 | Law | 446/462 |
| 4,468,884 | A | | 9/1984 | Goldfarb et al. | 446/462 |
| 4,492,058 | A | | 1/1985 | Goldfarb et al. | 446/462 |
| 4,498,887 | A | * | 2/1985 | Cook | 446/462 |
| 4,511,343 | A | | 4/1985 | Goldfarb et al. | 446/463 |
| 4,522,606 | A | | 6/1985 | Goldfarb et al. | 446/433 |
| 4,540,380 | A | | 9/1985 | Kennedy et al. | 446/463 |
| 4,547,166 | A | | 10/1985 | Goldfarb et al. | 446/164 |
| 4,591,347 | A | | 5/1986 | Goldfarb et al. | 446/462 |
| 4,652,247 | A | | 3/1987 | Goldfarb et al. | 446/164 |
| 4,684,354 | A | | 8/1987 | Orenstein | 446/130 |
| 4,734,077 | A | | 3/1988 | Taylor et al. | 446/462 |

FOREIGN PATENT DOCUMENTS

| | | | |
|---|---|---|---|
| GB | 841659 | | 7/1960 |
| GB | 942580 | | 11/1963 |
| GB | 2112656 | * | 7/1983 |
| GB | 2129320 A | * | 5/1984 |
| WO | WO8303774 | * | 11/1983 |

* cited by examiner

*Primary Examiner*—John A. Ricci
(74) *Attorney, Agent, or Firm*—Merchant & Gould P.C.

(57) ABSTRACT

A toy vehicle that is battery powered and driven by an electric motor mounted on the vehicle. The toy vehicle is designed for high and low speed operation in both a two-wheel drive mode and a four-wheel drive mode, as well as having a free wheel mode where the wheels are not in driving engagement with the electric motor. Thus the toy vehicle has at least five operating modes: 1) a higher speed two-wheel drive mode; 2) a lower speed two-wheel drive mode; 3) a higher speed four-wheel drive mode; 4) a lower speed four-wheel drive mode; and 5) a free wheel mode. Providing the toy vehicle with all of these operating modes makes the vehicle more interesting to children. In addition, the front end of the toy vehicle is designed to light up thereby increasing the visual appeal of the vehicle, especially for children. Further, the toy vehicle employs a unique electrical connection between the battery and the electric motor that does not require soldering or wiring, thereby simplifying assembly of the vehicle. Furthermore, a light bulb associated with the vehicle is electrically wired to the battery using clips, thereby eliminating the use of soldering.

16 Claims, 8 Drawing Sheets

TOY VEHICLE WITH VARIABLE DRIVE AND VARIABLE SPEED

FIELD OF THE INVENTION

This invention relates generally to toy vehicles, and more particularly to a toy vehicle that is capable of high and low speed operation in both a two-wheel drive mode and a four-wheel drive mode.

BACKGROUND OF THE INVENTION

An example of a known compact, battery powered toy vehicle is disclosed in U.S. Pat. No. 4,306,375 where a miniaturized electric motor powered by a battery is used to simultaneously drive front and rear axles, thereby producing four-wheel drive operation. In this toy vehicle, the axles and wheels are continuously engaged with the motor, so it is not possible for the vehicle to be operated by hand once the battery is exhausted.

Another known toy vehicle is disclosed in U.S. Pat. No. 4,540,380. This vehicle is powered by a battery operated motor through a shiftable transmission whereby the vehicle can operate in a low speed, four-wheel drive mode or in a high speed, two-wheel drive mode. Additionally, when the motor is turned off, the transmission is disengaged from the vehicle wheels to enable the vehicle to free wheel.

A further toy vehicle is disclosed in U.S. Pat. No. 4,591,347. This vehicle is designed for operation in both a high speed four-wheel drive mode and a low speed, four-wheel drive mode, as well as a neutral mode where the wheels are undriven.

Generally, a toy vehicle should be designed to operate and perform in a manner that is appealing to children. One of the ways to increase the appeal is to increase the operational capabilities of the vehicle and enable a child to select from a variety of different operating modes. Further, the vehicle should be designed with features that visually appeal to children and thereby make the vehicle more interesting to children.

Therefore, there is a continuing need for an improved battery operated, motor driven toy vehicle having a variety of operating modes and which has features that are visually appealing, to thereby increase the appeal of such toy vehicles to children.

SUMMARY OF THE INVENTION

The invention provides an improved toy vehicle, particularly a toy vehicle that is battery powered and driven by an electric motor mounted on the vehicle. The toy vehicle is designed for high and low speed operation in both a two-wheel drive mode and a four-wheel drive mode, as well as having a free wheel mode where the wheels are not in driving engagement with the electric motor. Thus the toy vehicle has at least five operating modes: 1) a higher speed two-wheel drive mode; 2) a lower speed two-wheel drive mode; 3) a higher speed four-wheel drive mode; 4) a lower speed four-wheel drive mode; and 5) a free wheel mode. Providing the toy vehicle with all of these operating modes makes the vehicle more interesting to children. In addition, the front end of the toy vehicle is designed to light up thereby increasing the visual appeal of the vehicle, especially for children.

Further, the toy vehicle of the invention employs a unique electrical connection between the battery and the electric motor that does not require soldering or wiring, thereby simplifying assembly of the vehicle. Furthermore, a light bulb associated with the vehicle is electrically wired to the battery using clips, thereby eliminating the use of soldering.

In one embodiment in accordance with the principles of the invention, a toy vehicle is provided which includes a chassis, front and rear axles rotatably mounted on the chassis, and a pair of wheels connected to each of the axles. An electric motor is mounted on the chassis, with the electric motor including a driveshaft for driving the front and rear axles. The toy vehicle further includes means for selectively driving both of the front and rear axles at a selected one of a first speed and a second speed, and for driving only one of the front and rear axles at a selected one of the first speed and the second speed.

In accordance with another embodiment of the invention, a toy vehicle is provided which includes a chassis, front and rear axles rotatably mounted on the chassis, and a pair of wheels connected to each of the axles. An electric motor is mounted on the chassis, with the electric motor including a driveshaft. The toy vehicle further includes front and rear gear mechanisms for driving the front and rear axles, respectively, with the front and rear gear mechanisms each providing a first speed and a second speed, and each of the front and rear gear mechanisms being actuatable between a freewheel mode at which the front and rear axles are not driven, a first speed mode at which the front and rear axles are driven at the first speed, and a second speed mode at which the front and rear axles are driven at the second speed. Front and rear shift mechanisms are connected to the front and rear gear mechanisms, respectively, for actuating the front and rear gear mechanisms between the freewheel mode, the first speed mode and the second speed mode, with the front and rear shift mechanisms being slideable relative to the chassis to actuate the front and rear gear mechanisms. A connector is engaged with the front and rear shift mechanisms, with the connector being moveable between a first position and a second position. The front and rear shift mechanisms are slideable together at the first position of the connector and the front and rear shift mechanisms are slideable relative to each other at the second position of the connector.

In yet another embodiment of the invention, a toy vehicle is provided which includes a chassis including a front end. A vehicle body is detachably connected to the chassis, with the vehicle body including a front end. Front and rear axles are rotatably mounted on the chassis, and a pair of wheels are connected to each of the axles. An electric motor is mounted on the chassis, with the electric motor including a driveshaft for driving the front and rear axles. A light bulb is mounted on the chassis at the front end thereof, and a transparent light bar is detachably connected to the vehicle body adjacent the front end thereof A variety of additional advantages of the invention will be set forth in part in the description which follows, and in part will be obvious from the description, or may be learned by practice of the invention. The advantages of the invention will be realized and attained by means of the elements and combinations particularly pointed out in the claims. It is to be understood that both the foregoing general description and the following detailed description are exemplary and explanatory only and are not restrictive of the invention as claimed.

DETAILED DESCRIPTION OF THE PREFERRED EMBODIMENT

The invention relates to a battery powered, electric motor driven toy vehicle that is selectively operable in the following modes: a four-wheel drive, high speed mode; a four-wheel drive, low speed mode; a two-wheel drive, high speed mode; a two-wheel drive, low speed mode; and a free wheel mode. The toy vehicle is designed such that any one of these mode can be selected at any time, thereby providing a large number of vehicle operating modes.

The invention further provides a battery powered, electric motor driven toy vehicle having a light distribution bar that is connected, preferably in a detachable manner, to the front end of the vehicle body, so as to distribute light from a light bulb mounted on the vehicle chassis through the front end of the vehicle body and thereby simulate headlights. The light distribution bar is also designed to extend below the bottom front edge of the vehicle body so as to form a portion of the front bumper of the vehicle body and to distribute light to the bottom front end of the toy vehicle thereby simulating ground light.

In an additional aspect, the invention further provides a battery powered, electric motor driven toy vehicle utilizing an electrical connection between the battery and the electric motor that does not utilize any soldering or wiring. A set of metallic strips electrically connect the battery, light bulb and electric motor, with a metallic shell of the electric motor forming a negative contact to the battery and to the light bulb. Furthermore, electrical contact between the light bulb and the battery is achieved using clips rather than soldering.

Figure 1:
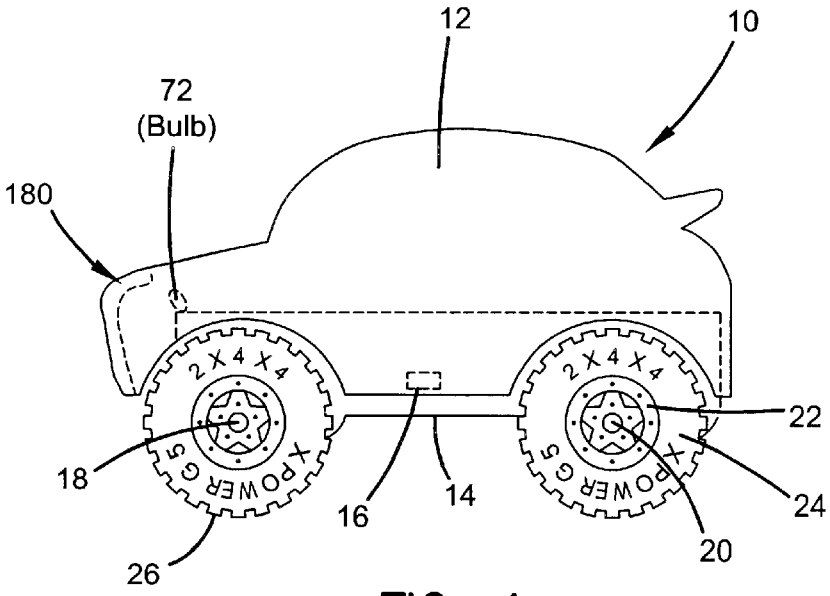
FIG. 1 is a side view of a toy vehicle in accordance with the invention, with a vehicle body detachably secured to a chassis.

One specific implementation of the invention is illustrated in FIGS. 1–12, with the toy vehicle being referenced by the numeral 10. With reference to FIG. 1, it can be seen that the toy vehicle 10 comprises a vehicle body 12 detachably mounted on a chassis 14. The body 12 is preferably made of molded plastic and is formed so as to simulate a vehicle. The body 12 is formed with tabs 16 on each of its sides on the interior surface thereof (only one tab being shown in the figures), with the tabs engaging with tabs formed on the chassis 14 to retain the body on the chassis. The tabs on the body 12 and chassis 14 form a snap connection whereby the body can snap on and off the chassis. This type of connection is conventional, and is not further described herein.

Figure 2:
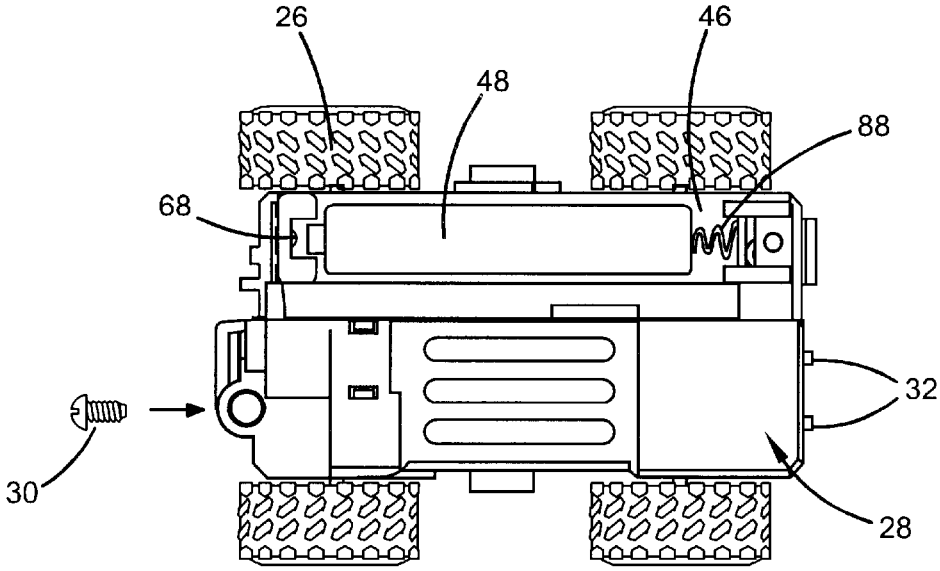
FIG. 2 is a top view of the chassis with the vehicle body removed therefrom.
Figure 3:
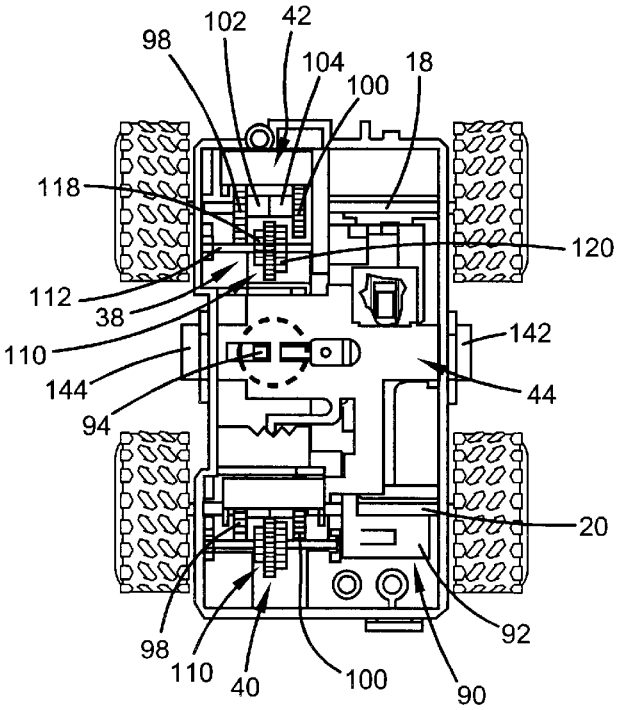
FIG. 3 is a further top view of the chassis with a motor cover removed to illustrate the drive gearing and shift mechanisms in a free wheel mode.

With reference to FIGS. 1 and 3, mutually parallel, spaced apart front and rear axles 18, 20, respectively, are rotatably mounted on the chassis 14, and wheels comprising hubs 22 having tires 24 thereon are fixed to the ends of each axle 18, 20, whereby the vehicle 10 is able to roll along the ground. The hubs 22 are made of a rigid plastic material, such as acrylonitrile butadiene styrene (ABS), while the tires 24 are made of a relatively hard and rigid plastic or rubber material, such as polyvinyl chloride (PVC). As is evident from FIGS. 1 and 2, the tires 24 are formed with a tread design 26 to increase the traction of the tires on the ground.

Figure 4:
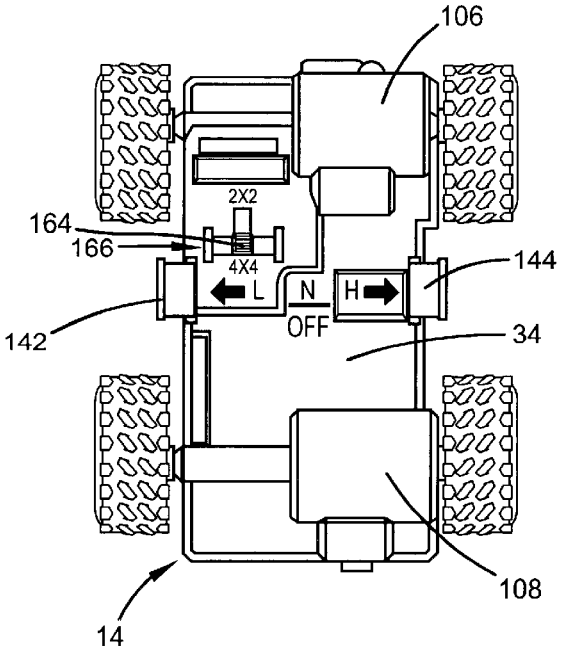
FIG. 4 is a bottom view of the chassis.
Figure 5:
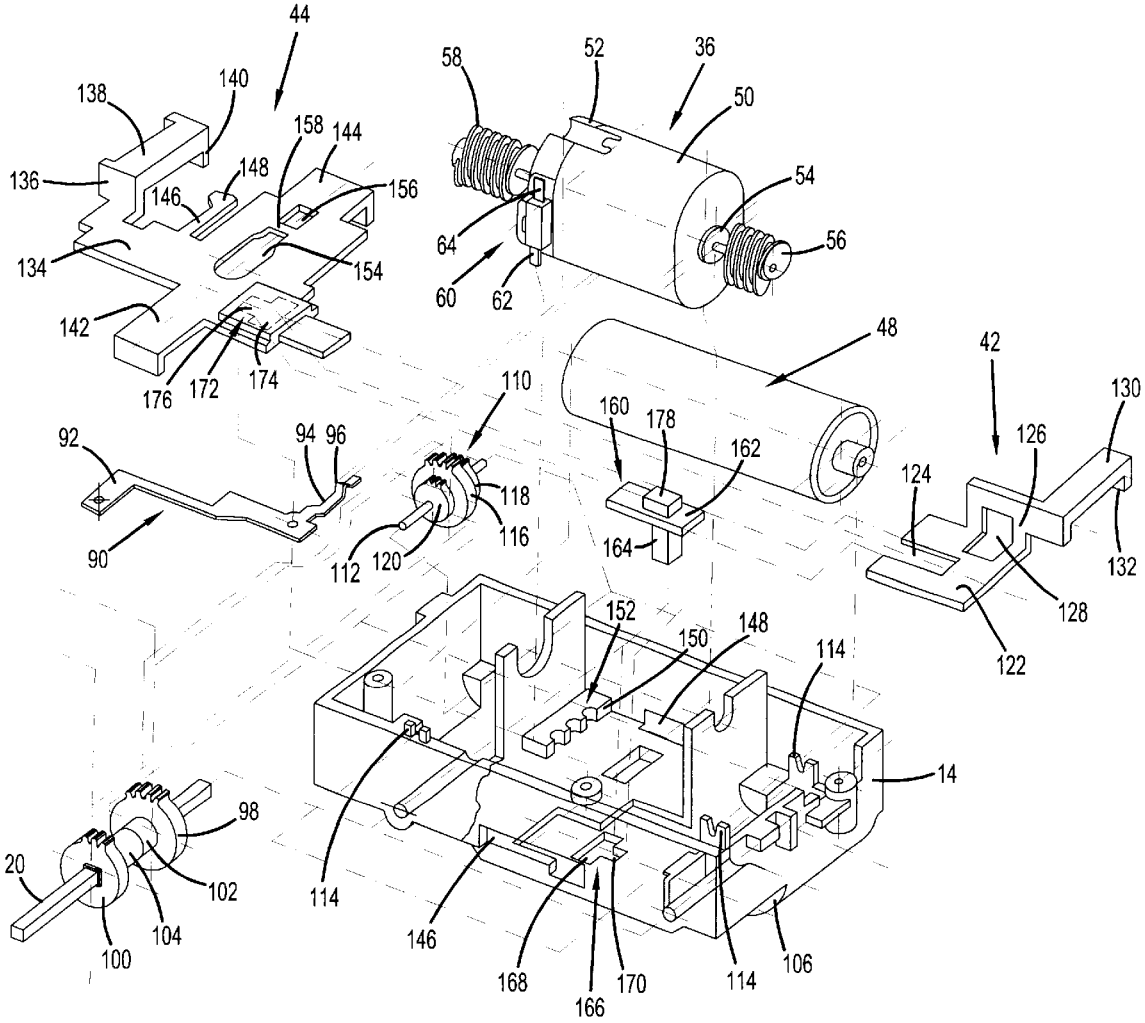
FIG. 5 is an exploded perspective view illustrating some of the components mounted on the chassis.

Turning to FIGS. 2, 3 and 5, a plastic motor cover 28 is removably secured to the chassis 14 via a screw 30 at one end and an integral clip 32 at the opposite end. Housed between the bottom of the cover 28 and a bottom wall 34 (FIG. 4) of the chassis 14 are an electric motor 36, front and rear gear mechanisms 38, 40 for driving the front and rear axles 18, 20, respectively, and front and rear shift mechanisms 42, 44 for selectively shifting the front and rear gear mechanisms, respectively. The cover 28 further defines a battery mounting recess 46 that is sized to receive a dry-cell battery 48, such as a AA-size battery, therein for providing electrical power to the motor 36. The battery 48, shown in dashed lines in FIG. 2, extends parallel to the longitudinal axis of the vehicle 10 and perpendicular to the axles 18, 20, and the recess 46 projects toward the bottom wall 34 of the chassis 14 such that the battery 48 is disposed approximately level with the motor 36 when mounted in the recess 46.

Figure 11:
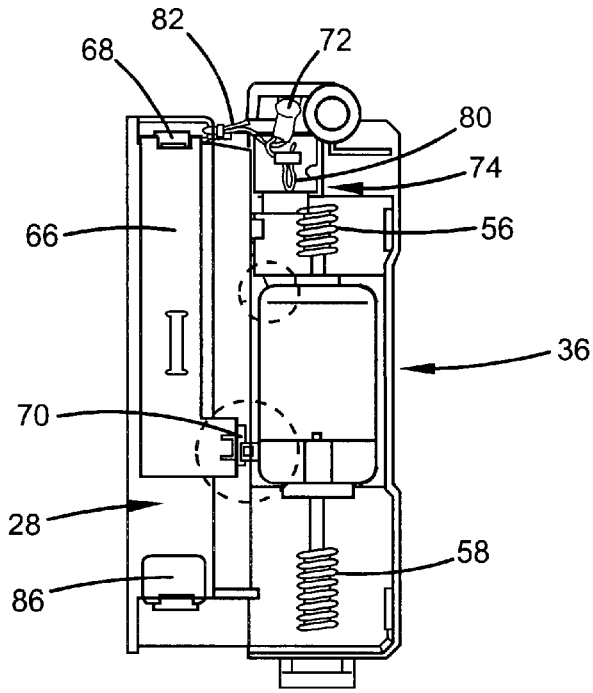
FIG. 11 is a bottom view of the motor cover with the motor disposed thereon.

The electric motor 36 that is used to drive the axles 18, 20 is illustrated in FIGS. 5 and 11. The motor 36, which is preferably a 1.5 V motor, includes a metal shell 50 that is closed at one end and open at its opposite end, with a plastic cap 52 closing off the open end of the shell 50. A double-ended driveshaft 54 is driven by the motor 36, with each end of the driveshaft having a worm 56, 58 fixed thereon forming a portion of the front and rear gear mechanisms 38, 40, respectively. The motor 36 further includes a terminal 60 thereon, with the terminal 60 having a negative contact 62 that is electrically connected to the metal shell 50, such as by being bent into contact therewith, and a positive contact 64 that contacts a positive battery contact 66.

Figure 12:
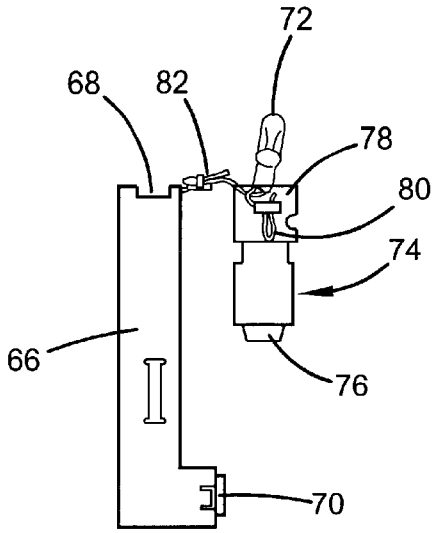
FIG. 12 illustrates a portion of the electrical connection between the battery mount and the electric motor.

With reference to FIGS. 11 and 12, it is seen that the positive battery contact 66 comprises a metallic strip that extends along the bottom of the motor cover 28 underneath the battery mounting recess 46, with the contact 66 including a first end 68 that is adapted to contact the positive terminal of the battery 48 (best seen in FIG. 2) and a second end 70 that is adapted to contact the positive contact 64 of the motor terminal 60.

As FIGS. 11 and 12 further show, a light bulb 72 is mounted underneath the motor cover 28 and projects upward through a hole provided in the motor cover 28 whereby the light bulb 72 illuminates the front end of the vehicle 10. A metallic strip 74 is mounted to the bottom surface of the motor cover 28 and extends parallel to the positive battery contact 66. The strip 74 includes an end 76 that makes contact with the metal shell 50 of the motor 36 and an end 78 that is adapted for electrical connection to a negative wire 80 of the light bulb 72. The light bulb 72 also includes a positive wire 82 that electrically connects to the positive battery contact 66.

Figure 13:
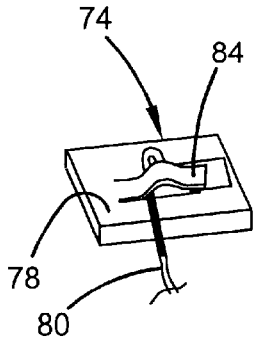
FIG. 13 illustrates a clip structure for electrically connecting a light bulb wire to a metallic strip.

The mechanism for electrically connecting the negative light bulb wire 80 to the end 78 of the strip 74 is illustrated in FIG. 13. The end 78 includes a cantilevered clip 84 that is integrally struck therefrom, with the clip being bowed outwards intermediate its ends to enable passage of the wire 80 therethrough. The wire 80, which is normally provided with electrical insulation, is stripped of its insulation adjacent the end of the wire, and the wire 80 is passed through the bowed portion of the clip 84 and then doubled back through the bowed portion, with the stripped end of the wire making contact with the metal end 78 thereby achieving electrical contact between the negative wire 80 of the light bulb 72 and the strip 74. The special design of the clip 84 thus achieves a secure connection of the wire 80 to end 78 and provides good electrical contact, without requiring soldering, thus simplifying assembly. The positive light bulb wire 82 is secured to the positive battery contact 66 using a clip that is similar to the clip 84.

The motor cover 28 further includes a negative battery contact 86 mounted thereon that includes the typical coil spring 88 that contacts the negative terminal of the battery 48, as shown in FIGS. 2 and 11. Electrical connection between the negative battery contact 86 and the motor 36 is provided by a metal strip 90 that is mounted on the chassis 14. As best seen in FIGS. 3 and 5, the strip 90 includes a first end 92 that is adapted to contact the negative battery contact 86 when the motor cover 28 is mounted on the chassis 14. The strip 90 is elongated and extends toward the center of the chassis 14, where a second, cantilevered end 94 of the strip is disposed. The cantilevered end 94 includes an upward projecting contact 96 that is disposed underneath the motor shell 50 for making contact therewith. As will be described in detail later, the contact 96 is selectively covered and uncovered by the rear shift mechanism 44. When covered, the contact 96 is prevented from contacting the motor shell 50, thereby preventing the electrical circuit between the battery 48 and the motor 36 from being completed so that the axles of the vehicle are not being driven. When the contact 96 is uncovered, the electrical circuit is completed so that the axles are driven by the motor 36.

The front and rear gear mechanisms 38, 40 for driving the axles 18, 20, respectively, are best seen in FIG. 3, with the components of the rear gear mechanism 40 being shown in detail in FIG. 5. Each gear mechanism 38, 40 includes a lower speed gear 98 and a higher speed gear 100 slideably mounted on the axles 18, 20 for sliding movement along the axis of the axles. The gears 98, 100 include integral collars 102, 104, respectively, that extend toward each other and into engagement, whereby the gears 98, 100 on any one of the axles 18, 20 are caused to move in unison upon applying a pushing force on one of the gears toward the other gear. Thus, if a pushing force is applied to the gear 98 that tends to push it toward the gear 100, both gears 98, 100 would slide simultaneously along the respective axle.

The gear 98 has a larger diameter and a larger number of teeth than the gear 100, so that the two gears 98, 100 enable the axles to be driven at two different speeds. For instance, in one embodiment, the gear 98 could have 22 teeth while the gear 100 has 18 teeth. However, it is to be realized that the gear 98 could be the higher speed gear and the gear 100 could be the lower speed gear. Further, the gears 98, 100 could have different numbers of gear teeth than those expressly recited in this example.

As shown in FIG. 5, the axle 20, as well as the axles 18, are preferably rectangular in cross-section, with the gears 98, 100 and collars 102, 104 having corresponding rectangular bores through which the axles pass so that the gears 98, 100 and axles rotate together, but the gears can slide axially along the axles. However, it is to be realized that other axles shapes could be used if desired, such as round axles, with the gears being rotatably fixed to the round axle while permitting axial sliding movements thereon, such as by using inter-engaging splines and grooves on the axle and gear bores, respectively. Further, as shown in FIGS. 4 and 5, the chassis 14 is formed with gear wells 106, 108 to accommodate the gears 98, 100.

With continued reference to FIGS. 3 and 5, each gear mechanism 38, 40 further includes an intermediate compound gear assembly 110, with each gear assembly 110 being engaged with a respective one of the worms 56, 58 on the double-ended driveshaft 54, and which are selectively engaged with one of the gears 98, 100 upon actuation of the gears 98, 100 along the respective axle 18, 20. Each compound gear assembly 110 comprises a shaft 112 that is rotatably mounted in mounts 114 formed on the chassis 14 such that the shafts 112 extend generally parallel to the axles 18, 20. A worm gear 116 is fixed on the shaft 112 and rotates therewith, and a lower speed gear 118 and a higher speed gear 120 are fixed to the shaft 112 on opposite sides of the worm gear 116 immediately adjacent thereto. Preferably, the gears 118, 120 contact the worm gear 116 so as to minimize the size of the gear assembly 110.

The worm gears 116 are designed to provide a desired gear ratio between the worms 56, 58 and the worm gears 116. Further, like the gears 98, 100, the gears 118, 120 have different diameters and different numbers of gear teeth to provide for two different driving speeds.

For instance, in one embodiment, the worm gears 116 can have 22 teeth, to provide a gear ratio between the worms and worm gears of 1:22. Further, the lower speed gear 118 can have 8 teeth while the higher speed gear 120 has 12 teeth. Provided that the gears 98, 100 have 22 teeth and 18 teeth, respectively, the gear ratio at the lower speed (i.e. gears 98, 118 engaged) is thus 8:22 or 1:2.75, while the gear ratio at the higher speed (i.e. gears 100, 120 engaged) is 12:18 or 1:1.5. The mechanical advantage provided by such a design is 33:1 in the faster mode, and 60.5:1 in the slower mode. It is to be realized that other gear ratios could be utilized as well.

The worm gears 116 are preferably in driving engagement with the worms 56, 58, such that rotation of the worms causes rotation of the worm gears 116 and the gears 118, 120. As is evident from FIG. 3, the distance between the facing surface of the gears 98, 100 is greater than the distance between the gears 118, 120 such that the gears 98, 100 are initially out of engagement with the gears 118, 120 so that the axles 18, 20 are not driven and the vehicle can freewheel. However, since the gears 98, 100 are slideable along the axles, actuation of the gears 98, 100 to the right in FIG. 3 can bring the gear 98 into driving engagement with the gear 118, while actuation of the gears 98, 100 to the left in FIG. 3 can bring the gear 100 into driving engagement with the gear 120. Thus, provision of the different axle driving speeds is provided through shifting of the gears 98, 100 along one or both of the axles 18, 20 to thereby selectively bring one of the gears 98, 100 into engagement with the corresponding gear 118, 120 on the gear assembly 110.

The front and rear shift mechanisms 42, 44 are used to shift the gears 98, 100 along one or both of the axles 18, 20. The shift mechanisms 42, 44 will be described with reference to FIGS. 3 and 5. The front shift mechanism 42 comprises a generally planar horizontal connection portion 122 that is slideably disposed on the chassis 14 for sliding movements back and forth in a direction parallel to the axle 18. A slot 124 is formed in the portion 122 for a purpose which will become apparent later. A generally vertical wall portion 126 extends upward from the portion 122 to a height greater than the height the gears 98, 100 extend above the axle 18. A slot 128 is formed both in the horizontal portion 122 and the vertical portion 126, to accommodate the mount 114 and the shaft 112 when the front shift mechanism 42 is properly located, and to allow shifting of the shift mechanism 42 to the left and right (when viewing FIG. 3).

The front shift mechanism 42 further includes a shifting fork 130 that is connected to the wall portion 126 and extends generally parallel to the axle 18. A shoulder 132 extends downward from the end of the fork 130 facing the wall portion 126. The fork 130 extends generally above the gears 98, 100, with the shoulder 132 being disposed slightly to the left of the gear 98 when viewing FIG. 3, and with the wall portion 126 being disposed slightly to the right of the gear 100 when viewing FIG. 3. Thus, by sliding the shift mechanism 42 to the left in FIG. 3, the wall portion 126 contacts the gear 100 and pushes it and the gear 98 to the left, whereby the gear 100 is brought into driving engagement with the gear 120. Similarly, by sliding the shift mechanism 42 to the right in FIG. 3, the shoulder 132 contacts the gear 98 and pushes it and the gear 100 to the right, whereby the gear 98 is brought into driving engagement with the gear 118.

Returning to FIG. 5, it is seen that the rear shift mechanism 44 comprises a horizontal, generally planar portion 134 that is slideably disposed on the chassis 14 for sliding movements back and forth in a direction parallel to the axle 20. A generally vertical wall portion 136 extends upward from the horizontal portion 134, and a shifting fork 138 is connected to the portion 136 and extends generally parallel to the axle 20. A shoulder 140 extends downward from the end of the fork 138 facing the wall portion 136. The fork 138 extends generally above the gears 98, 100, with the shoulder 140 being disposed slightly to the left of the gear 98 when viewing FIG. 3, and with the wall portion 136 being disposed slightly to the right of the gear 100 when viewing FIG. 3. Thus, by sliding the shift mechanism 44 to the left in FIG. 3, the wall portion 136 contacts the gear 100 and pushes it and the gear 98 to the left, whereby the gear 100 is brought into driving engagement with the gear 120. Similarly, by sliding the shift mechanism 44 to the right in FIG. 3, the shoulder 140 contacts the gear 98 and pushes it and the gear 100 to the right, whereby the gear 98 is brought into driving engagement with the gear 118.

The rear shift mechanism 44 is further provided with a pair of tabs 142, 144 that are connected to opposite sides of the horizontal portion 134. The chassis 14 is provided with a pair of slots 146, 148 through which the tabs 142, 144 extend so that the tabs project outward from the sides of the chassis as is seen in FIG. 4. The projecting tabs 142, 144 thus form actuators by which the rear shift mechanism 44 can be slid to the left and right. Thus, by pushing the tab 142 to the left in FIG. 3, the rear shift mechanism is slid to the left, thereby pushing the gears 98, 100 to the left as described above. Pushing the tab 144 to the right in FIG. 3 slides the shift mechanism 44 to the right, thereby pushing the gears 98, 100 to the right.

A resilient indexing arm 146 is further connected to the horizontal portion 134 for retaining the rear shift mechanism 44 in each of three positions. The first position is the freewheel position in which the gears 98, 100 and 118, 120 are not engaged, and the axle 20 freewheels. The second position is a lower-speed position at which the gear 98 is engaged with the gear 118. The third position is a higher-speed position at which the gear 100 is engaged with the gear 120. The indexing arm 146 includes a finger 148 that engages with grooves 150 on an indexing rack 152 formed on the chassis 14. The rack 152 includes three of the grooves 150, with the middle groove corresponding to free-wheel position, the groove on the right (in FIG. 3) corresponding to the lower-speed position, and the groove on the left (in FIG. 3) corresponding to the higher-speed position. The finger 148 is adapted to cooperate with a respective one of the grooves 150 so as to retain the shift mechanism 44 at the desired position. However, application of a sufficient pushing force to one of the tabs 142, 144 is able to force the finger from its current groove and into an adjacent groove.

Figure 7A:
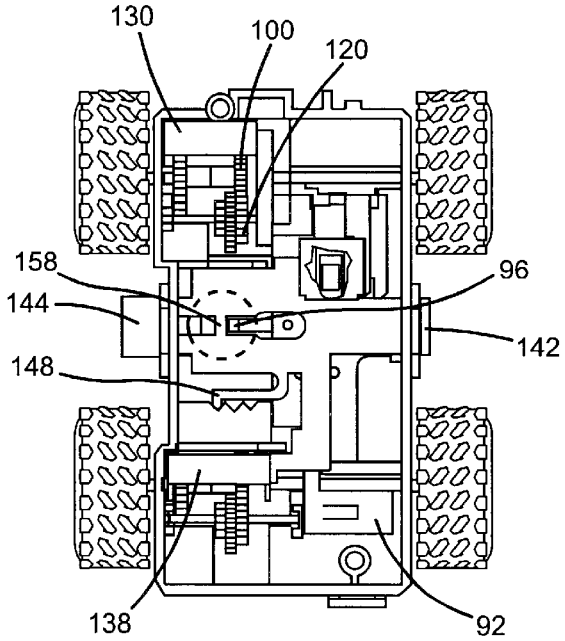
FIG. 7A is a view similar to FIG. 3 with the vehicle in a four-wheel drive, higher speed mode.
Figure 7B:
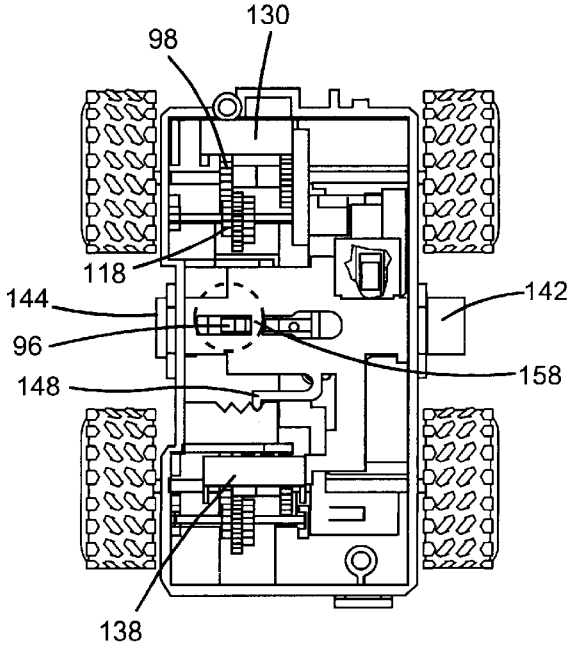
FIG. 7B is a view similar to FIG. 7A but with the vehicle in a four-wheel drive, lower speed mode.
Figure 8A:
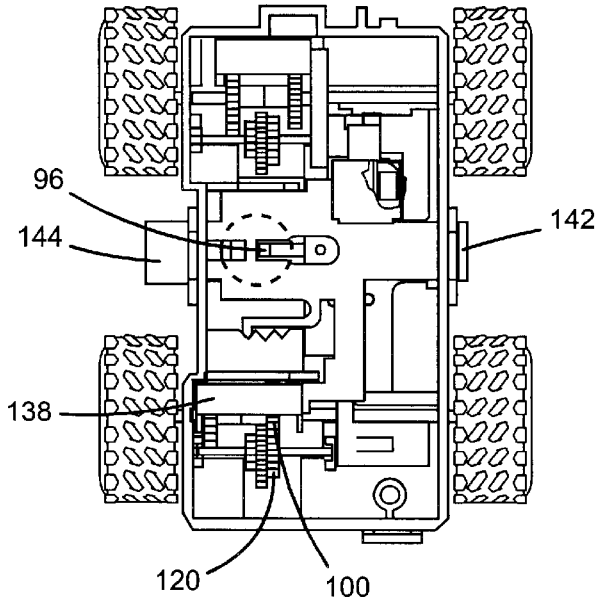
FIG. 8A is a view similar to FIG. 7A but with the vehicle in a two-wheel drive, higher speed mode.
Figure 8B:
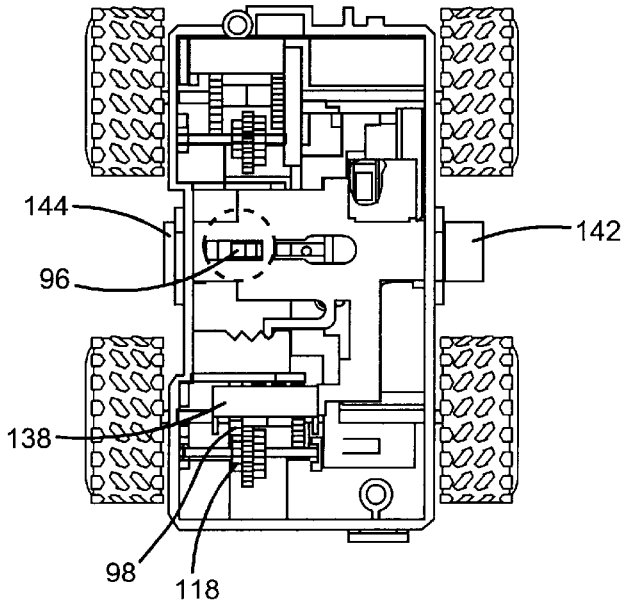
FIG. 8B is a view similar to FIG. 7A but with the vehicle in a two-wheel drive, lower speed mode.

Further, as best seen in FIG. 5, a pair of cut-outs 154, 156 are formed in the horizontal portion 134 between the tabs 142, 144, with the cut-outs 154, 156 being separated form each other by a bar 158. The bar 158 is sized and shaped to cover and uncover the contact 96 and thereby control operation of the motor 36. At the first, free-wheel position of the shift mechanism 44 shown in FIG. 3, the bar 158 covers the contact 96 and prevents it from contacting the motor 36. Therefore, the electrical circuit is not completed and the motor is "off". When the shift mechanism 44 is slid to the right, the bar 158 uncovers the contact 96 and the contact projects upwardly through the cut-out 156 and into engagement with the motor so the motor is "on" (FIGS. 7B and 8B). Likewise, when the shift mechanism 44 is slid to the left, the bar 158 uncovers the contact 96 and the contact projects upwardly through the cut-out 154 and into engagement with the motor to complete the electrical circuit so the motor is "on" (FIGS. 7A and 8A).

As was indicated previously, the vehicle is adapted for operation both in two-wheel drive and four-wheel drive. Since the tabs 142, 144 are connected to the rear shift mechanism 44, only the rear gears 98, 100 will slide into engagement with the gears 118, 120 unless a mechanism is provided for causing the front shift mechanism 42 to move with the rear shift mechanism 44. The mechanism for selectively connecting the front and rear shift mechanisms 42, 44 is shown in FIG. 5 in the form of a connector 160.

The connector 160 is actuatable between a first, four-wheel drive position at which the front and rear shift mechanisms 42, 44 are connected so as to move together when the tabs 142, 144 are pushed to enable engagement of both the front and rear drive gear mechanisms 38, 40, and a second, two-wheel drive position at which the rear shift mechanism 44 moves to engage the rear drive mechanism 40 while the front shift mechanism 42 is stationary and the front gear mechanism 38 is disengaged.

Figure 6A:
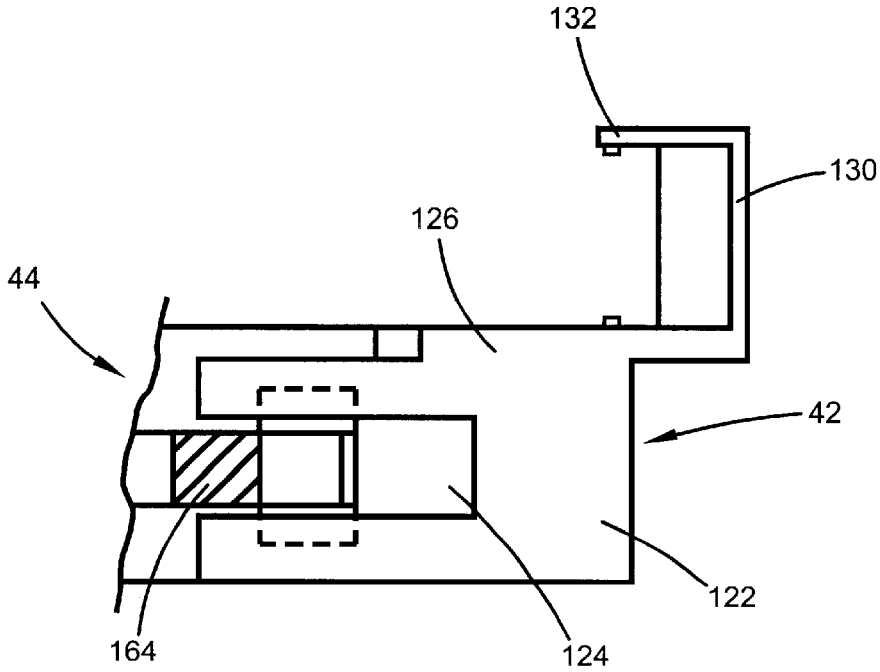
FIG. 6A is a bottom view of the front and rear shift levers and the lever connector, with the lever connector in the four-wheel drive position so that the front and rear shift levers move together.
Figure 6B:
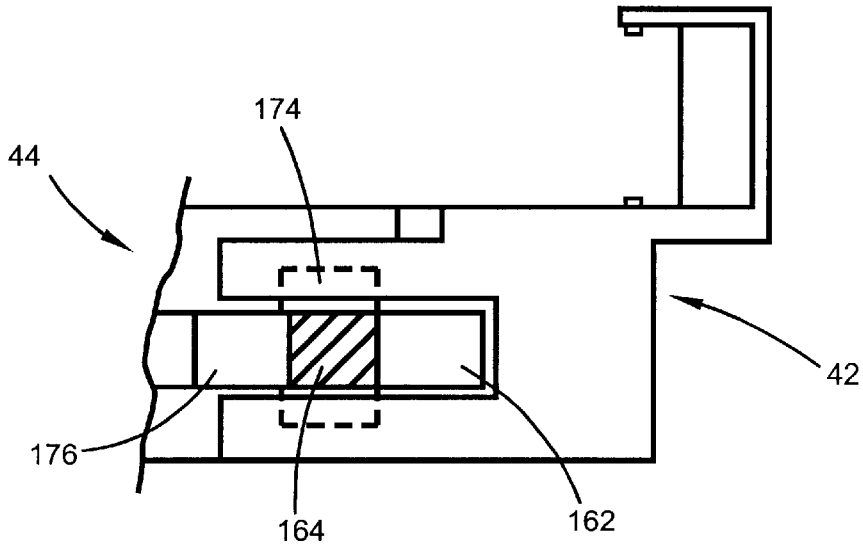
FIG. 6B is a bottom view similar to FIG. 6A, but with the lever connector in the two-wheel drive position so that the rear shift lever can slide while the front shift lever remains stationary.

With reference to FIGS. 5, 6A and 6B, the connector 160 includes a platform portion 162 that is slideably received within the slot 124 of the front shift mechanism 42, with the horizontal portion 122 of the front shift mechanism 42 being disposed underneath the front end of the horizontal portion 134 of the rear shift mechanism 44 as best seen in FIGS. 6A and 6B. An actuating stem 164 extends from the bottom of the platform portion 162 and through a T-shaped slot 166 formed through the bottom wall 34 of the chassis 14, whereby the stem 164 projects below the bottom of the chassis 14 to enable actuation of the stem 164. The T-shaped slot 166 includes a cap portion 168 extending generally parallel to the axles 18, 20 and a stem portion 170 extending generally perpendicular to the cap portion 168, with the stem 164 being moveable within the confines of the slot 166.

The front end of the horizontal portion 134 of the rear shift mechanism 44 includes a T-shaped channel 172, shown in dashed lines in FIG. 5, on the bottom side thereof. The T-shaped channel 172 is located generally vertically above the T-shaped slot 166 and includes a cap portion 174 extending generally parallel to the axles 18, 20 and disposed above the stem portion 170, and a stem portion 176 extending generally perpendicular to the cap portion 174 and disposed above the cap portion 168. A button 178 projects from the top surface of the platform portion 162 and into the T-shaped channel 172, with the button 178 being located directly opposite from the stem 164.

The connector 160 is actuatable back and forth between a four-wheel drive position and a two-wheel drive position. At the four-wheel drive position, the stem 164 is pushed all the way to the rear such that it is disposed within the cap portion 168 of the T-shaped slot 166 at the base of the stem portion 170. Since the T-shaped channel 172 is oriented opposite the T-shaped slot 166, the button 178 will be located at the bottom of the stem portion 176 of the channel 172 as shown in FIG. 6A. At the four-wheel drive position then, the platform portion 162 is disposed within the slot 124, the button 178 is located in the stem portion 176, and the stem 164 is in the middle of the cap portion 168 such that when the tabs 142, 144 are pushed to the left or right, both of the shift mechanisms 42, 44 move together to the left or right, with the stem 164 traveling along the length of the cap portion 168. Thus, since both shift mechanisms 42, 44 are shifted, both gear mechanisms 38, 40 can be engaged such that the vehicle 10 can operate in a four-wheel drive, higher speed mode and a four-wheel drive, lower speed mode.

However, at the two-wheel drive position, the stem 164 is pushed all the way toward the front of the vehicle such that it is disposed at the end of the stem portion 170. The platform portion 162 thus slides forward in the slot 124 and the button 178 moves into the middle of the cap portion 174 of the T-shaped channel 172. The button 178 and the cap portion 174 of the channel 172 permit shifting of the rear shift mechanism 44 relative to the front shift mechanism 42 when the tabs 142, 144 are pushed to the left or right, such that only the rear gear mechanism 40 is engaged and only the rear axle 20 is driven. Thus, the vehicle 10 is operable in a two-wheel drive, higher speed mode and a two-wheel drive, lower speed mode.

FIGS. 7A and 7B show the vehicle 10 in the four-wheel drive, higher speed mode and the four-wheel drive, lower speed mode. In FIG. 7A, the connector 160 is pushed all the way to the rear such that the front and rear shift mechanisms 42, 44 are constrained to move together. When the tab 142 is pushed to the left, the shift mechanisms 42, 44 move together to the left, thereby bringing the gears 100 into engagement with the gears 120. Simultaneously, the bar 158 uncovers the contact 96 which projects upward through the cut-out 154 and into contact with the shell 50 of the motor 36 thereby completing the electrical circuit and turning the motor "on". Thus, both the front and rear axles 18, 20 will be driven at a relatively higher speed by a drive train comprising the worms 56, 58, the worm gears 116, the gears 120 and the gears 100.

In FIG. 7B, the connector 160 remains in the same position as in FIG. 7A. However, the tab 144 is pushed to right, thereby causing the front and rear shift mechanisms 42, 44 to move together to the right thereby bringing the gears 98 into engagement with the gears 118. Simultaneously, the bar 158 uncovers the contact 96 which projects upward through the cut-out 156 and into contact with the shell 50 of the motor 36 thereby completing the electrical circuit and turning the motor "on". Thus, both the front and rear axles 18, 20 will be driven at a relatively lower speed by a drive train comprising the worms 56, 58, the worm gears 116, the gears 118 and the gears 98.

FIGS. 8A and 8B show the vehicle 10 in the two-wheel drive, higher speed mode and the two-wheel drive, lower speed mode. In FIG. 8A, the connector 160 is pushed all the way toward the front of the vehicle 10, such that only the rear shift mechanism 44 moves while the front shift mechanism 42 remains stationary with the gear mechanism 38 disengaged. When the tab 142 is pushed to the left, the shift mechanism 44 moves to the left, thereby bringing the gear 100 into engagement with the gear 120. Simultaneously, the bar 158 uncovers the contact 96 which projects upward through the cut-out 154 and into contact with the shell 50 of the motor 36 thereby completing the electrical circuit and turning the motor "on". Thus, only the rear axle 20 is driven at a relatively higher speed by a drive train comprising the worm 58, the worm gear 116, the gear 120 and the gear 100.

In FIG. 8B, the connector 160 remains in the same position as in FIG. 8A. However, the tab 144 is pushed to right, thereby causing the rear shift mechanism 44 to move to the right thereby bringing the gear 98 into engagement with the gear 118. Simultaneously, the bar 158 uncovers the contact 96 which projects upward through the cut-out 156 and into contact with the shell 50 of the motor 36 thereby completing the electrical circuit and turning the motor "on". Thus, only the rear axle 20 is driven at a relatively lower speed by a drive train comprising the worm 58, the worm gear 116, the gear 118 and the gear 98.

Figure 10:
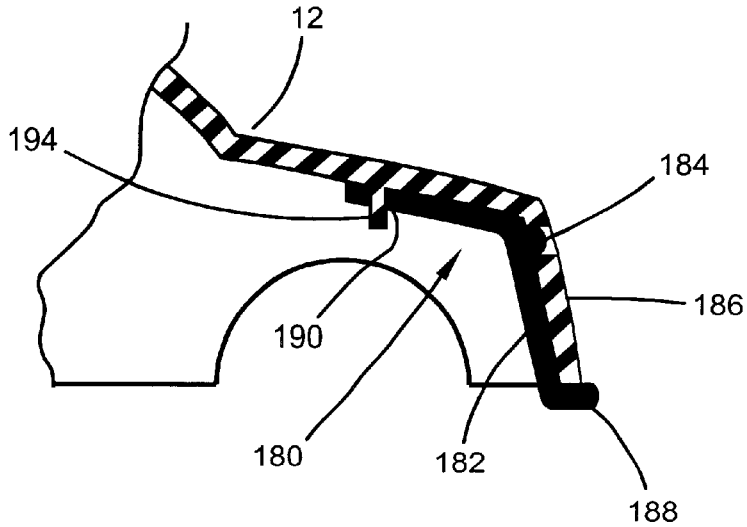
FIG. 10 illustrates how the light distribution bar is removably attached to the front end of the vehicle body.

As was mentioned previously, a light distribution bar 180 is mounted on the vehicle body 12, preferably in a detachable manner, so as to distribute light from the light bulb 72 over the front end of the vehicle 10. FIGS. 1 and 10 show that the light distribution bar 180 is disposed at the front end of the vehicle body 12 and is mounted generally on the inside surface thereof, in front of the light bulb 72 mounted on the chassis 14. The light distribution bar 180 is made from a transparent material, such as a transparent plastic, so as to allow light to be transmitted therethrough.

Figure 9:
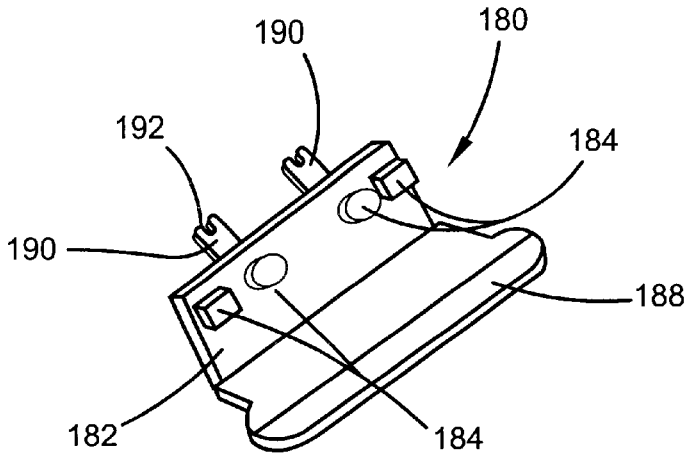
FIG. 9 is a front perspective view of the light distribution bar.

Details of the light distribution bar 180 are shown in FIG. 9. The bar 180 is sized and shaped so as to cover substantially the entire front end of the vehicle body 12, and includes a front portion 182 disposed against the inside surface of the front end of the body 12. The front end of the body 12 is preferably designed to simulate the front end of an actual vehicle, including a front bumper and headlights. To simulate headlights, the front portion 182 of the bar 180 includes a plurality of shaped projections 184 thereon which penetrate through correspondingly shaped holes 186 (only one hole being visible in FIG. 10) formed in the front end of the vehicle body 12. The projections 184 are preferably tinted as certain color, such as yellow, orange, red, etc. so that the projections 184 more closely simulate lights at the front of an actual vehicle. Since the projections 184 penetrate through the holes 186 and through the front end of the vehicle body 12, when the light bulb 72 is lit, the light therefrom is transmitted through the projections 184, such that the projections 184 simulate headlights, fog lights or other lights typically found at the front end of an actual vehicle.

The bar 180 further includes a flange 188 that is connected to the base of the front portion 182 and is disposed underneath the bottom front edge of the vehicle body 12. The flange 188 thus forms a portion of the front bumper of the vehicle body 12, as well as distributing light from the bulb 72 to the bottom front edge of the body 12, thereby simulating a ground light.

As shown in FIG. 9, a pair of spaced tabs 190 are connected to the front portion 182 and extend rearwardly therefrom, with each tab 190 including a slot 192 formed in the end thereof. A pair of connecting posts 194 (only one post being visible in FIG. 10) are formed on the inner surface of the body 12 and extend downwardly therefrom. The posts 194 are adapted to be frictionally received in the slots 192 so as to detachably connect the bar 180 to the body 12. The frictional engagement between the posts 194 and slots 192 is sufficient to retain the bar 180 in place during use of the vehicle 10, but can be overcome by manual force to allow the light bar 180 to be detach and reattached as desired.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A toy vehicle, comprising:

a chassis;

front and rear axles rotatably mounted on said chassis, and a pair of wheels connected to each said axle;

an electric motor mounted on said chassis, said electric motor including a driveshaft for driving said front and rear axles; and means for selectively driving both of said front and rear axles at a first speed and a second speed, and for driving only one of said front and rear axles at the first speed and the second speed while the other of said front and rear axles is not driven.

2. The toy vehicle according to claim 1, further comprising a vehicle body detachably connected to said chassis, said vehicle body including a front end; and a transparent light bar is detachably connected to said vehicle body adjacent said front end.

3. The toy vehicle according to claim 1, wherein said electric motor includes a metal shell, and a terminal mounted on the motor having a negative contact connected to the metal shell and a positive contact; and further comprising a metal strip mounted on said chassis and having a first end adapted for engagement with a battery and a second end adapted for engagement with the positive contact.

4. A toy vehicle, comprising:

a chassis;

front and rear axles rotatably mounted on said chassis, and a pair of wheels connected to each said axle;

an electric motor mounted on said chassis, said electric motor including a driveshaft;

front and rear gear mechanisms for driving said front and rear axles, respectively, said front and rear gear mechanisms each providing a first speed and a second speed, and each said front and rear gear mechanism being actuatable between a freewheel mode at which the front and rear axles are not driven, a first speed mode at which the front and rear axles are driven at the first speed, and a second speed mode at which the front and rear axles are driven at the second speed;

front and rear shift mechanisms connected to the front and rear gear mechanisms, respectively, for actuating the front and rear gear mechanisms between the freewheel mode, the first speed mode and the second speed mode, said front and rear shift mechanisms being slideable relative to the chassis to actuate the front and rear gear mechanisms; and a connector engaged with the front and rear shift mechanisms, said connector being moveable between a first position and a second position, said front and rear shift mechanisms being slideable together at the first position of the connector and said front and rear shift mechanisms being slideable relative to each other at the second position of the connector.

5. The toy vehicle according to claim 4, wherein said driveshaft is a double-ended driveshaft having a front portion extending from one end of the motor and a rear portion extending from an opposite end of the motor; and said front and rear gear mechanisms comprise a front worm and a rear worm mounted on the front and rear portions of the driveshaft, respectively, and first and second gears slideably disposed on each of the front and rear axles and engageable with the front and rear worms.

6. The toy vehicle according to claim 5, wherein said front and rear gear mechanisms further comprise front and rear intermediate compound gear assemblies mounted on shafts that are parallel to said front and rear axles, each said intermediate compound gear assembly including a worm gear engaged with a respective one of said front and rear worms, and first and second intermediate gears mounted on opposite sides of said worm gear and engageable with said first and second gears disposed on a respective one of said front and rear axles.

7. The toy vehicle according to claim 5, wherein said first and second gears on each of said front and rear axles include collars that engage each other whereby the first and second gears contact each other, and said front and rear shift mechanisms are engageable with said first and second gears whereby said first and second gears are shifted along the respective said front and rear axles upon sliding movement of said front and rear shift mechanisms.

8. The toy vehicle according to claim 4, wherein said connector is slideable with said front and rear shift mechanisms when said connector is at the first position.

9. The toy vehicle according to claim 4, wherein said rear shift mechanism is slideable and said front shift mechanism is fixed when said connector is at the second position.

10. The toy vehicle according to claim 4, further comprising a vehicle body detachably connected to said chassis, said vehicle body including a front end; and a transparent light bar is detachably connected to said vehicle body adjacent said front end.

11. The toy vehicle according to claim 10, wherein said light bar includes a plurality of projections thereon, and the front end of said vehicle body includes holes extending therethrough into which said projections extend.

12. The toy vehicle according to claim 10, wherein said light bar includes a flange extending under the front end of the vehicle body.

13. The toy vehicle according to claim 10, wherein said vehicle body includes posts connected thereto, and said light bar includes tabs that are connected to said posts.

14. The toy vehicle according to claim 4, wherein said electric motor includes a metal shell, and a terminal mounted on the motor having a negative contact connected to the metal shell and a positive contact; and further comprising a first metal strip mounted on said chassis and having a first end adapted for engagement with a battery and a second end adapted for engagement with the positive contact.

15. The toy vehicle according to claim 14, further including a light bulb mounted on said chassis, and a second metal strip mounted on the chassis, said light bulb being electrically connected adjacent to the first end of said first metal strip and to the second metal strip, and an end of said second metal strip being engaged with the metal shell of said electric motor.

16. The toy vehicle according to claim 15, wherein said light bulb includes a pair of light bulb wires, and said first metal strip and said second metal strip each include clips formed thereon connecting the light bulb wires thereto.

* * * * *